US011278131B2

(12) United States Patent
Nunez

(10) Patent No.: US 11,278,131 B2
(45) Date of Patent: Mar. 22, 2022

(54) SYSTEM AND APPARATUS FOR DISPLAYING BUTTONS

(71) Applicant: Ruben Nunez, Mission Hills, CA (US)

(72) Inventor: Ruben Nunez, Mission Hills, CA (US)

( * ) Notice: Subject to any disclaimer, the term of this patent is extended or adjusted under 35 U.S.C. 154(b) by 275 days.

(21) Appl. No.: 16/502,735

(22) Filed: Jul. 3, 2019

(65) Prior Publication Data

US 2019/0322421 A1 Oct. 24, 2019

Related U.S. Application Data

(63) Continuation-in-part of application No. 15/444,303, filed on Feb. 27, 2017, now abandoned.

(60) Provisional application No. 62/300,181, filed on Feb. 26, 2016.

(51) Int. Cl.

| | |
|---|---|
| ***A47F 7/03*** | (2006.01) |
| ***A45C 13/02*** | (2006.01) |
| ***A47G 1/12*** | (2006.01) |
| ***A45C 11/24*** | (2006.01) |
| ***A47F 3/14*** | (2006.01) |
| ***B65D 6/02*** | (2006.01) |
| ***B65D 25/10*** | (2006.01) |
| ***B65D 43/16*** | (2006.01) |
| ***B65D 85/58*** | (2006.01) |

(52) U.S. Cl.

CPC ..... *A47F 7/03* (2013.01); *A45C 11/24* (2013.01); *A45C 13/02* (2013.01); *A47F 3/145* (2013.01); *A47G 1/12* (2013.01); *B65D 9/06* (2013.01); *B65D 25/108* (2013.01); *B65D 43/163* (2013.01); *B65D 85/58* (2013.01)

(58) Field of Classification Search

CPC . A47F 7/03; A47F 3/145; A45C 11/24; A45C 13/02; A47G 1/22; B65D 9/06; B65D 25/108; B65D 85/58; B65D 21/0204; B65D 1/30

USPC ..... 206/45.2

See application file for complete search history.

(56) References Cited

U.S. PATENT DOCUMENTS

| | | | | |
|---|---|---|---|---|
| 303,783 | A | 8/1884 | Zimerman | |
| 341,001 | A | 5/1886 | Hall | |
| 480,045 | A * | 8/1892 | H. B. Sommer | A47F 7/02 206/566 |
| 1,388,094 | A | 8/1921 | Buttigieg | |
| 1,456,613 | A * | 5/1923 | Bartels | A47F 7/03 206/731 |
| 1,531,502 | A | 4/1924 | Raizen | |
| 1,527,719 | A * | 2/1925 | Wetherell | A47F 7/02 206/348 |

(Continued)

*Primary Examiner* — Ernesto A Grano

(74) *Attorney, Agent, or Firm* — Jafari Law Group, Inc.

(57) ABSTRACT

The invention generally involves a button display system and button display apparatus for storing, organizing, and facilitating a display of at least one button. The button display system comprises a storage container and an apparatus that is exemplarily, although not necessarily modular. The modular device may be a modular rack assembly removably coupled to an interior of the storage container. The modular rack assembly may include a plurality of modular rack trays, each of the plurality of modular rack trays including a plurality of slits configured to receive a portion of a button positioned in a slanted orientation. The button display system enables systematic organization of at least one, but usually several buttons, effectively storing, preserving, and facilitating their display.

8 Claims, 10 Drawing Sheets

(56) References Cited

U.S. PATENT DOCUMENTS 1,735,060 A 7/1928 Shields
2,052,432 A 9/1935 Warner
2,041,303 A 10/1935 Shields
2,122,738 A * 7/1938 Drummond ..... A47F 7/03 206/749
2,219,597 A * 10/1940 Lutz ..... A45D 29/20 206/755
2,354,872 A * 8/1944 Mitnick ..... A47B 81/067 211/40
2,634,018 A 12/1947 Mageau
D161,139 S * 12/1950 Shapiro ..... D6/682.4
D167,862 S * 9/1952 Schladermundt et al. .... D6/661
2,709,517 A 5/1955 Young
2,788,123 A 4/1957 Levis
D180,987 S * 9/1957 Ayres, Jr. et al. ..... D6/661
3,425,538 A * 2/1969 Lott, Jr. ..... A47F 7/03 206/0.83
3,507,071 A * 4/1970 Bryson ..... A01K 97/06 43/57.1
3,554,625 A * 1/1971 Sly, Jr. ..... A47F 7/03 312/234
3,710,900 A * 1/1973 Fink ..... A45C 13/02 206/387.15
D227,726 S * 7/1973 Sinclair ..... D6/661
D238,133 S 12/1975 Uebele
3,960,268 A * 6/1976 Davis ..... B65D 61/00 206/456
3,964,603 A * 6/1976 Sandler ..... A47F 7/024 206/560
4,040,518 A * 8/1977 Carter ..... B65D 25/107 206/387.15
4,069,941 A * 1/1978 Popplewell, Jr. ..... A47F 7/147 206/215
D256,522 S * 8/1980 Peterson ..... D3/284
4,350,249 A * 9/1982 Caston ..... B65D 25/10 206/466
4,375,850 A * 3/1983 Smyth ..... G11B 23/023 206/387.15
4,448,303 A * 5/1984 Beckenfeld ..... B65D 5/524 206/45.3
4,627,535 A * 12/1986 Kirchner ..... G11B 23/0236 206/387.15
4,676,372 A * 6/1987 Rager ..... G11B 33/0438 206/232
4,712,679 A * 12/1987 Lowe ..... G11B 33/0455 206/308.1
D300,095 S * 3/1989 Robinson ..... D6/682.4
4,917,235 A * 4/1990 Feiler ..... A47F 7/022 206/566
5,118,171 A 6/1992 Ortiz
5,148,942 A * 9/1992 Snook ..... B65D 25/06 206/425
D330,975 S * 11/1992 Stafford ..... D3/270
5,170,893 A * 12/1992 Smith ..... G11B 33/0444 206/308.1
D353,508 S * 12/1994 Sankey ..... D6/407
5,570,781 A * 11/1996 Bond ..... B65D 5/504 206/308.1
5,791,468 A * 8/1998 House ..... G11B 33/0405 206/308.1
5,908,118 A * 6/1999 Tyler ..... G11B 33/0466 211/40
6,874,619 B1 * 4/2005 Hawkes ..... A47F 7/02 206/499
6,991,115 B2 * 1/2006 Chow ..... G11B 33/0483 211/188
D588,907 S * 3/2009 Cesario, Jr. ..... D9/418
9,386,865 B2 * 7/2016 Bally ..... A61B 50/20
9,731,860 B2 * 8/2017 Kretz ..... B65D 5/5038
D839,595 S * 2/2019 Asher ..... D3/295
2002/0079313 A1 * 6/2002 Grayson ..... A01K 97/06 220/23.4
2005/0211582 A1 * 9/2005 Richards ..... G11B 33/0466 206/308.1
2006/0180481 A1 8/2006 McGaughey
2007/0075028 A1 * 4/2007 Nagel ..... A47F 3/0486 211/59.2
2011/0084040 A1 * 4/2011 Curtin ..... H04M 1/04 211/126.7
2013/0213846 A1 * 8/2013 Hendrickson ..... B65D 21/0231 206/509
2013/0299363 A1 * 11/2013 De Lecce ..... A47F 3/14 206/6.1
2014/0353177 A1 * 12/2014 Senate ..... B65B 55/00 206/6.1
2016/0031148 A1 * 2/2016 Hendrickson ..... B65D 1/40 264/523
2017/0196330 A1 * 7/2017 Watson ..... A47G 29/08
2017/0325441 A1 * 11/2017 Martin ..... B65D 43/22
2018/0042209 A1 * 2/2018 Aston ..... A01K 83/00

* cited by examiner

FIG. 9
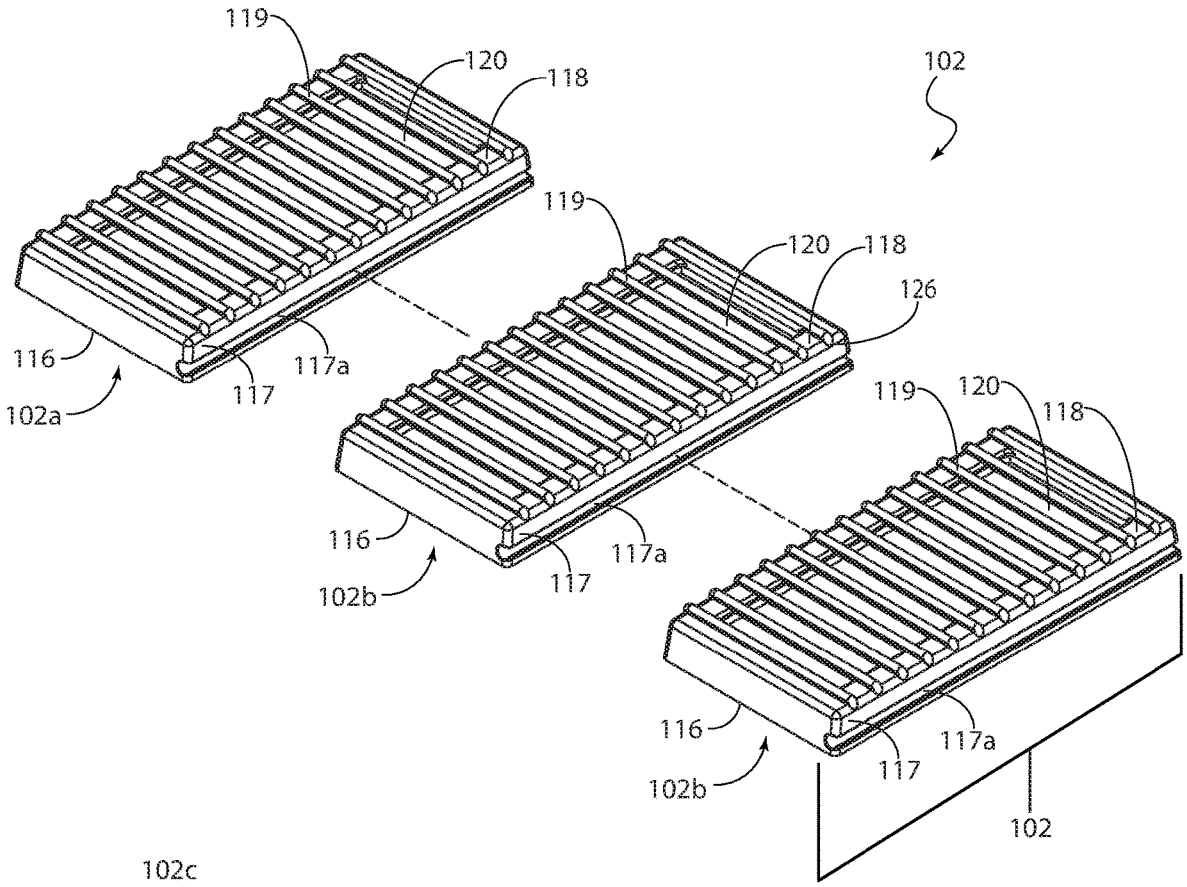
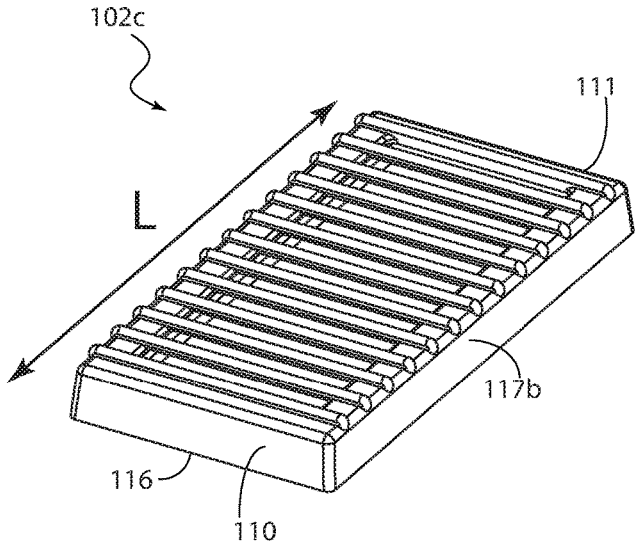
FIG. 10

SYSTEM AND APPARATUS FOR DISPLAYING BUTTONS

PRIORITY NOTICE

The present application claims priority under 35 U.S.C. § 120 to and is a continuation-in-part application of U.S. Non-provisional patent application with Ser. No. 15/444,303 filed on Feb. 27, 2017, which claims priority under 35 U.S.C. § 119(e)(1) to U.S. Provisional Applications with Ser. No. 62/300,181 filed Feb. 26, 2016, the disclosure of which are incorporated herein by reference in their entirety.

TECHNICAL FIELD OF THE INVENTION

The present invention relates generally to the field of display systems. More specifically, the present invention relates to a system and apparatus for displaying buttons.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

When individuals think about times and moments in their lives that they would like to record and revisit, the events fall into one of two categories. First, there are moments when the individual participates as actor and observer, such as photographing and recording family vacations, high school graduations, weddings and christenings. Second, there are times in which the individual participates as actor and someone else observes and captures the individual in the event, such as acting in a community play, competing in a golf tournament, attending a formal dance, running a marathon or participating in a sports league.

In the specific case of sports leagues one popular way of commemorating a team and its season is by creating a photo button, a pin or magnet backed button bearing a photo of a player in their uniform. While these photo buttons make terrific keepsakes for both players, coaches and admirers, they often are stored in a box or a drawer, ransackedly arranged and rarely seen again after being placed in the storage area of choice.

The prior art has put forth several designs for memento display devices, however those prior art disclosures do not adequately address the display of buttons, because they are particularly designed to display other types of mementos such as photograph sheets and other items. Moreover, even using those types of devices does not adequately facilitate the proper display of buttons that are decorative, include photographs, or are otherwise memento buttons.

Therefore, there exists a previously unappreciated need for a system and apparatus for displaying buttons. It is to these ends that the present invention has been developed.

SUMMARY OF THE INVENTION

To minimize the limitations in the prior art, and to minimize other limitations that will be apparent upon reading and understanding the present specification, the present invention describes a system and apparatus for storage, organization, and presentation of photo buttons and other types of buttons that may be desirably stored and displayed.

Generally, the invention involves a button display system and button display apparatus for storing, organizing, and facilitating a display of at least one button. The button display system comprises a storage container and an apparatus that is exemplarily, although not necessarily modular. The modular device may be a modular rack assembly removably coupled to an interior of the storage container. The modular rack assembly may include a plurality of modular rack trays, each of the plurality of modular rack trays including a plurality of slits configured to receive a portion of a button positioned in a slanted orientation. The button display system enables systematic organization of at least one, but usually several buttons, effectively storing, preserving, and facilitating their display.

A button display system, in accordance with an exemplary embodiment of the present invention, comprises: a storage container; and a modular rack assembly removably coupled to an interior of the storage container, the modular rack assembly including a plurality of modular rack trays, each of the plurality of modular rack trays including a plurality of slits configured to receive a portion of a button positioned in a slanted orientation.

A button display system, in accordance with an exemplary embodiment of the present invention, comprises: a storage container; and a modular rack assembly removably coupled to an interior of the storage container, the modular rack assembly including a plurality of modular rack trays, each of the plurality of modular rack trays including: a base; a first side wall having a protruding member along a length of the first side wall; a second side wall having a channel along a length of the second side wall; and a plurality of rails perpendicularly secured between the first side wall and the second side wall forming the slits configured to receive a portion of a button, wherein: the protruding member along the length of the first side wall is configured to removably couple with a complementary channel of at least one of the plurality of modular rack trays of the modular rack assembly, and the channel along the length of the second side wall is configured to removably couple with a complimentary protruding member of at least one of the plurality of modular rack trays of the modular rack assembly.

A button display apparatus, in accordance with an exemplary embodiment of the present invention, comprises: a plurality of rack trays removably coupled to an interior of a storage container, at least one of the plurality of rack trays including: a base; a first side wall having a protruding member along a length of the first side wall; a second side wall having a channel along a length of the second side wall; and a plurality of rails perpendicularly secured between the first side wall and the second side wall forming the slits configured to receive a portion of a button positioned in a slanted orientation, wherein: the protruding member along the length of the first side wall is configured to removably couple with a complementary channel of at least one of the plurality of modular rack trays of the modular rack assembly, and the channel along the length of the second side wall is configured to removably couple with a complimentary protruding member of at least one of the plurality of modular rack trays of the modular rack assembly.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

The system and apparatus for displaying buttons as disclosed herein are further described in terms of exemplary embodiments. These exemplary embodiments are described in detail with reference to the drawings, which have not necessarily been drawn to scale in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows:

FIG. 9 illustrates an exploded view of an apparatus for displaying buttons in accordance with some exemplary embodiments of the present invention.

FIG. 10 illustrates a perspective view of an apparatus for displaying buttons in accordance with some exemplary embodiments of the present invention.

DETAILED DESCRIPTION OF THE INVENTION

Figure 1:
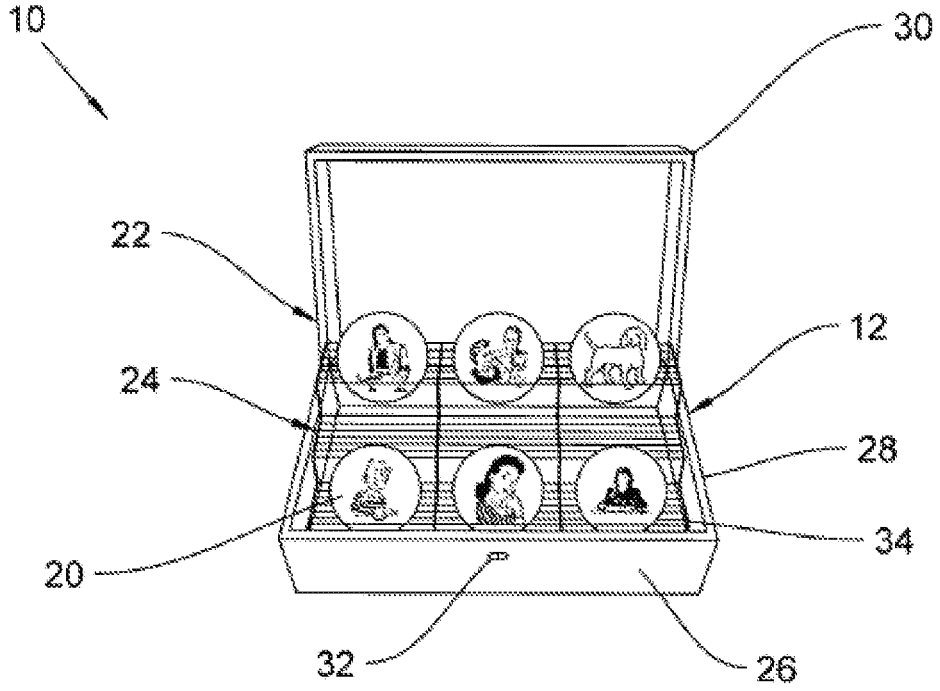
FIG. 1 is a perspective view illustrating a first embodiment of a button display system, constructed in accordance with the present invention, presented as a rectangular wooden box containing a hinged lid and an interior bottom portion lined with trays on which titled buttons reside for easy viewing.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy. Similarly, terms, such as "a, an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

The present disclosure relates to, among other things, a system and apparatus for displaying buttons. Exemplary embodiments of the present disclosure are described with reference to the drawings for illustration purposes and are not intended to limit the scope of the present disclosure.

Figure 2:
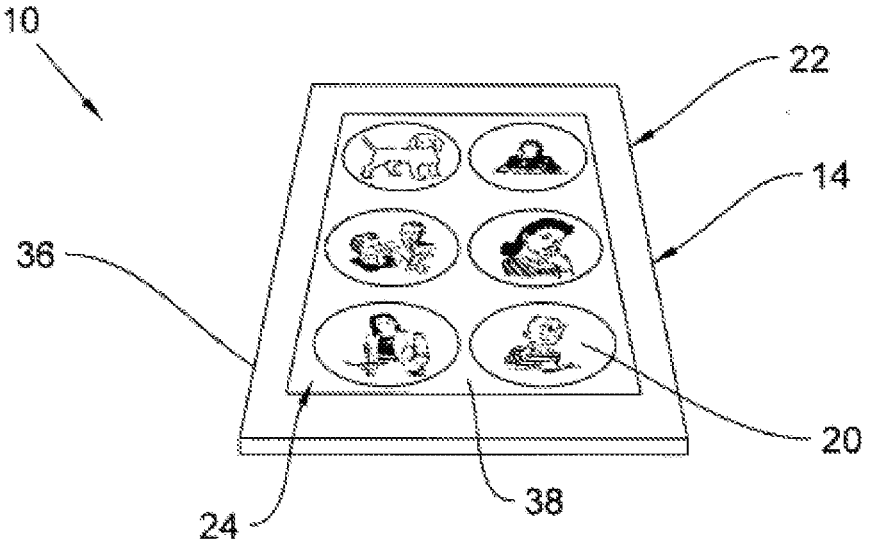
FIG. 2 is a perspective view illustrating a second embodiment of a button display system, constructed in accordance with the present invention, presented as a rectangular wall frame covered in fabric and holding approximately six buttons.
Figure 3:
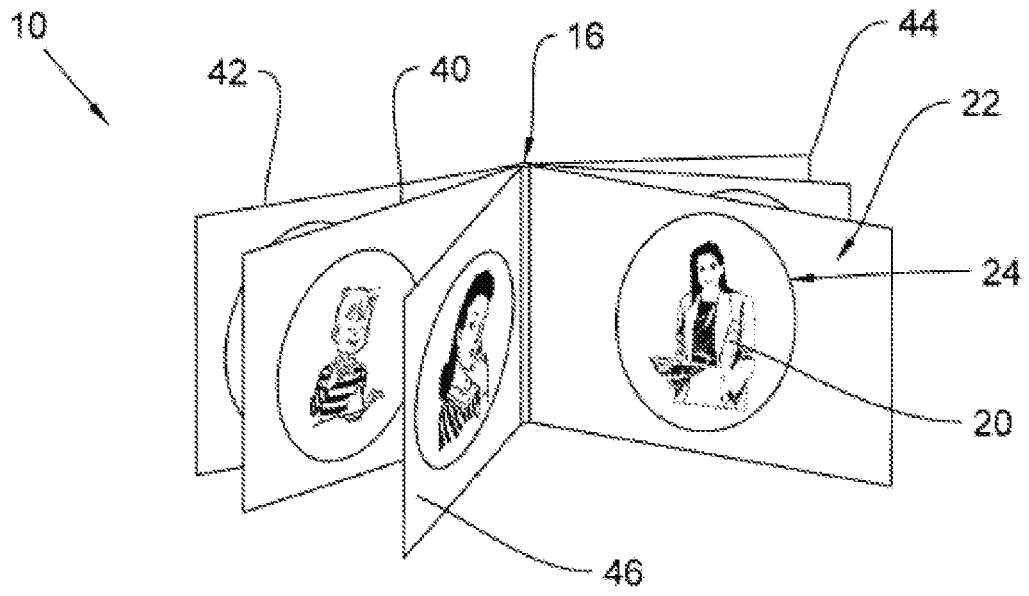
FIG. 3 is a perspective view illustrating a third embodiment of a button display system, constructed in accordance with the present invention, presented as an album book containing multiple pages for viewing buttons stored on front and back side walls of each page.
Figure 4:
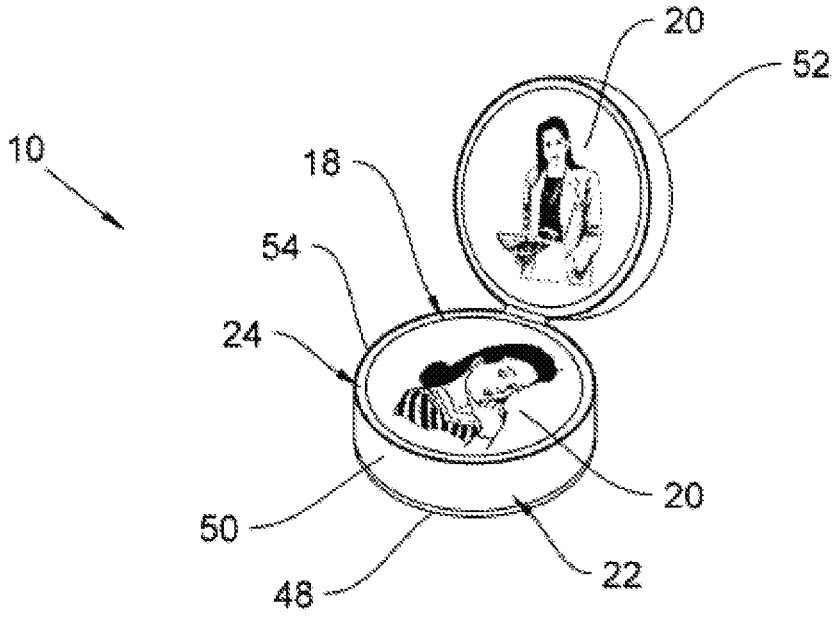
FIG. 4 is a perspective view illustrating a fourth embodiment of a button display system, constructed in accordance with the present invention, presented as a round container in which individual buttons with rubber coated backing are stacked, stored, and movably displayable.

Turning now to the first set of figures, FIG. 1 is a perspective view illustrating a first embodiment of a button display system, constructed in accordance with the present invention, presented as a rectangular wooden box containing a hinged lid and an interior bottom portion lined with trays on which titled buttons reside for easy viewing; FIG. 2 is a perspective view illustrating a second embodiment of a button display system, constructed in accordance with the present invention, presented as a rectangular wall frame covered in fabric and holding approximately six buttons; FIG. 3 is a perspective view illustrating a third embodiment of a button display system, constructed in accordance with the present invention, presented as an album book containing multiple pages for viewing buttons stored on front and back side walls of each page; and FIG. 4 is a perspective view illustrating a fourth embodiment of a button display system, constructed in accordance with the present invention, presented as a round container in which individual buttons with rubber coated backing are stacked, stored, and movably displayable.

In these views, a button display system, indicative generally at 10, is a line of display and storage containers 12, wall frames 14, albums 16, and decorative box 18 configured particularly for storage, organization, and presentation of photo buttons and other display buttons 20. The Button Display System 10 enables individuals to systematically organize photo and other display buttons 20, effectively storing, preserving, and displaying them for generations to come. The Button Display System 10 includes variously sized containers 12, wall frames 14, albums 16, and boxes frames 18 to accommodate small to large buttons 20 in small to large quantities.

Button Display System 10 includes a button display housing 22 and a button retaining mechanism 24 for releasably mounting the button 20 to the button display housing 22. In a first embodiment, the button display housing 22 is a tabletop container 26 for displaying the buttons 20 on a tabletop or other surface (not shown). The tabletop container 26 has a base 28 and four side wails perpendicular extending from the base and a lid or cover 30. Preferably the lid 30 is hingedly connected to the base 28 allowing the lid 30 to move from a closed position to an open position and back to the closed position. A clasp or latch 32 can be mounted to the container 26 to releasably secure the lid 30 in the closed position.

The button retaining mechanism 24 of the first embodiment of the Button Display System 10 of the present invention includes a rack 34 positioned within the base 28 of the container 28 The rack 34 is a framework or stand in or on which to hold, hang, or display the buttons 20 for securing or positioning each button 20 in a standing position in distinct rows with the buttons 20 tilted for easy viewing In a preferred embodiment, the rack 34 has three (3) levels for allowing easier viewing of the displayed buttons 20 although more levels or less levels are within the scope of the present invention.

The rack 34 of the button retaining mechanism 24 of the Button Display System 10 of the present invention can be secured, either releasably or fixedly, within the container 26, or simply placed within the container 26 resting on the base 28 within the lateral confines of the four side walls. The rack 34 can also be sized and shaped for extending only up to a top end of the side walls or can be sized and shaped to actually extend above the top end of the side wails, yet still be contained beneath the lid 30.

In a preferred embodiment, the container 28 of the Button Display System 10 of the present invention is preferably constructed from a wood, metal, plastic, cardboard, or other stiff material although constructing the container 26 from a different material is within the scope of the present invention, in addition, preferably, the rack 34 of the button retaining mechanism of the Button Display System 10 is a grate style shelf constructed from a plastic or rubber coated, metal material although constructing the rack 34 from different materials Is within the scope of the present invention.

In a second embodiment, the button display housing 22 of the Button Display System 10 of the present invention is a wall frame 36. A standard way frame 36 accommodates approximately six (2) buttons 20 in two vertical rows of three buttons 20 each. It should be noted that the wall frame 36 of the present invention can be constructed in a variety of shapes and sizes to hold more or less than six (6) buttons 20.

The button retaining mechanism 24 of the second embodiment of the Button Display System 10 of the present invention includes a backing 38 mounted within the wall frame 38 with the backing 38 either constructed from a padded material or a sturdy material. With the padded material the button 20 is releasably secured to the backing 38 using the pin or other connector associated with the button 20. With the sturdy material, the button 20 can be fixedly or releasably secured to the backing 38 using an adhesive substance or mechanism clasp which holds the button 20 on the desired position.

In a third embodiment, the button display housing 22 of the Button Display System 10 of the present invention Includes a folding desktop or tabletop album 40 that accommodates and displays several photo and other display buttons 20 of various sizes. The album 40 has a front cover 42 and a rear cover 44 with at least one page 46 bound between the front cover 42 and the rear cover 44. In a preferred embodiment, the album has a plurality of pages 46 mounted between the front cover 42 and the rear cover 44. The front cover 42 and the rear cover 44 are preferably constructed from a leather, vinyl, or fabric material although constructing the front cover 42 and the rear cover 44 from other materials is within the scope of the present invention.

The button retaining mechanism 24 of the third embodiment of the Button Display System 10 of the present invention includes the button 24 fixedly or releasably secured to the page 46 using an adhesive substance or mechanism clasp which holds the button 20 on the desired position. In the alternative, the button retaining mechanism 24 can include a recess formed in the page(s) 20 for insertion of the button 20 therein such that the button 20 snugly fits within the recess and releasably held in position by friction.

In a fourth embodiment, the batten display housing 22 of the Button Display System 10 of the present Invention includes a round or heart shaped container 48 having a bottom portion 50 and a fop portion 52 hingedly con memo to the bottom portion 50 The top portion 52 and the bottom portion 50 of the container 48 each hold at least a single button 20 with the ability for the buttons 20 to stack upon each other. In addition, an Interior surface of the top portion 52 and the bottom portion 50 each include a padding material 54 covered with a velvet cover. An outside surface of the top portion 52 and the bottom portion 50 are preferably covered with a vinyl or leather material.

The button retaining mechanism 24 of the fourth embodiment of the Button Display System 10 of the present invention includes the button 20 fixedly or releasably secured within the container 48 using an adhesive substance or mechanism clasp which holds the button 20 on the desired position. In the alternative, the button retaining mechanism 24 can simply include positioning the button within 20 the top section 52 and the bottom section 50. Friction or other mechanical means can be used, or not, to releasably secure the button 20 in position.

The present invention meets the needs of a variety of photo and other display button collectors. Parents may wish to display only a few buttons 20 in a family room, players may wish to display a number of buttons 20 in their bedrooms, and coaches may wish to display buttons 20 from multiple teams over a span of coaching seasons. Button Display System 10 also is ideally functional for collectors of comical, political, sports themed, and other buttons 20. Durably constructed and finished with high quality and aesthetically attractive materials, the Button Display System 10 will withstand many years of continued use.

Figure 5:
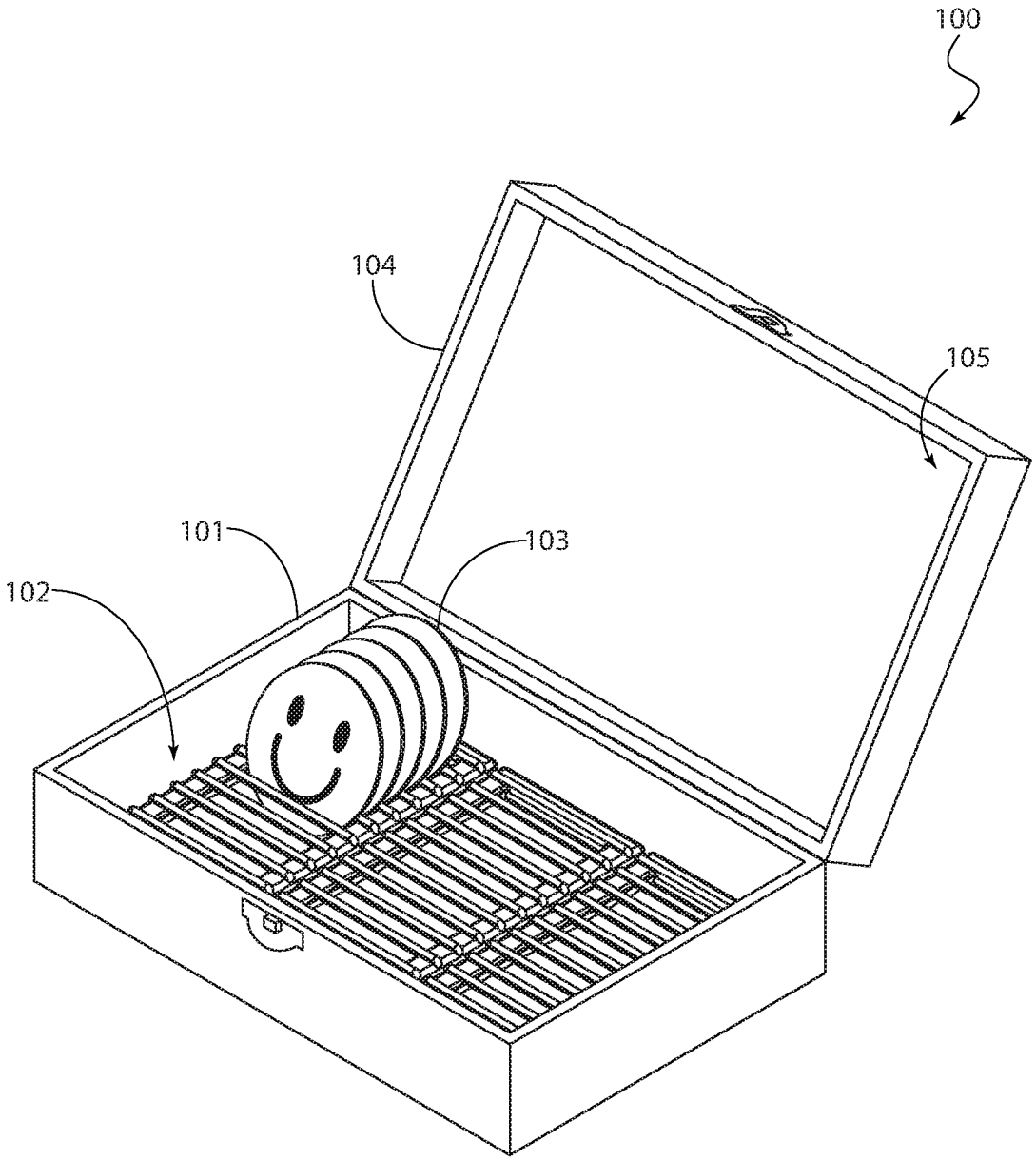
FIG. 5 illustrates a perspective view of a system for displaying buttons in accordance with some exemplary embodiments of the present invention.
Figure 6:
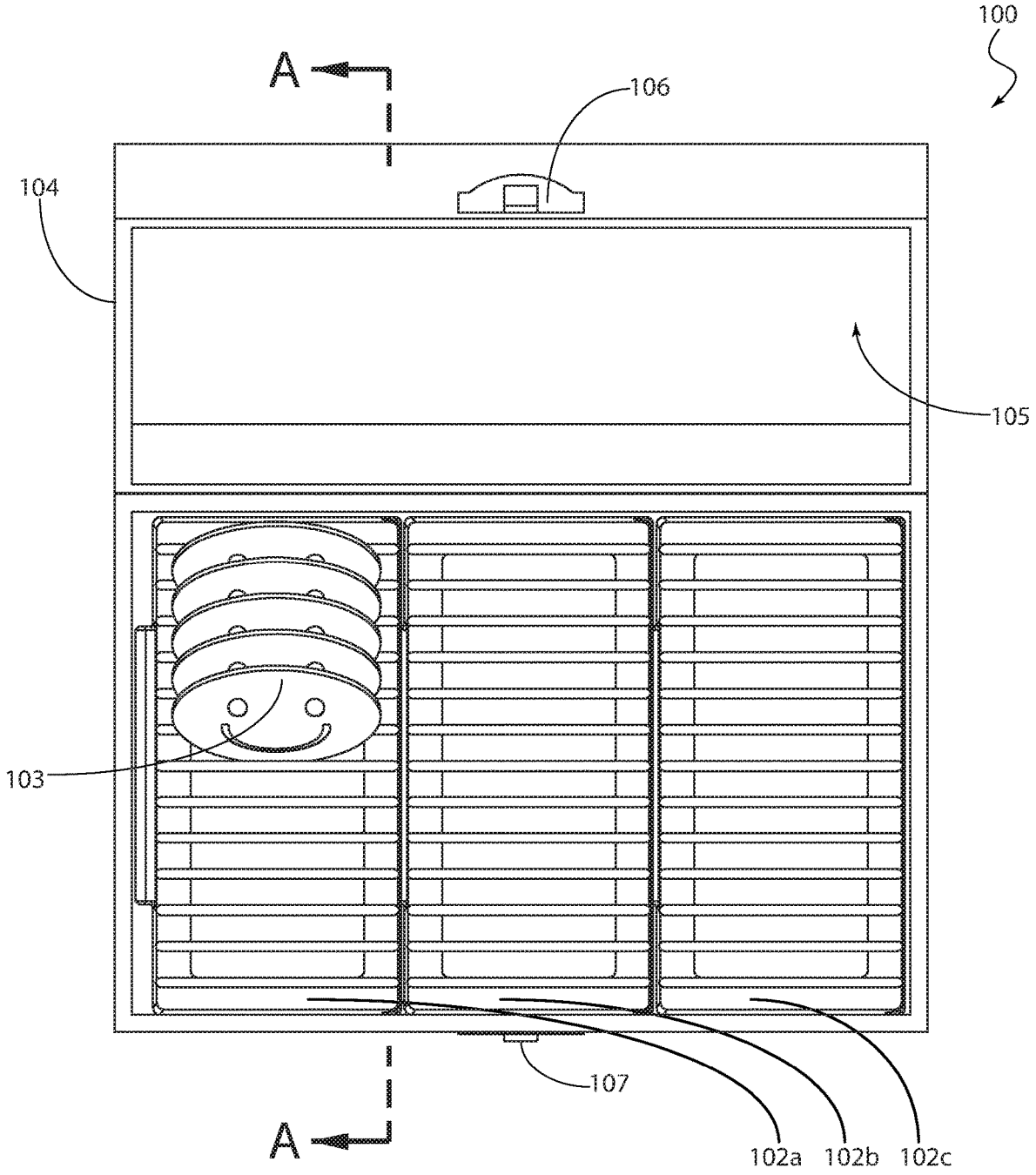
FIG. 6 illustrates a top view of a system for displaying buttons in accordance with some exemplary embodiments of the present invention.
Figure 7:
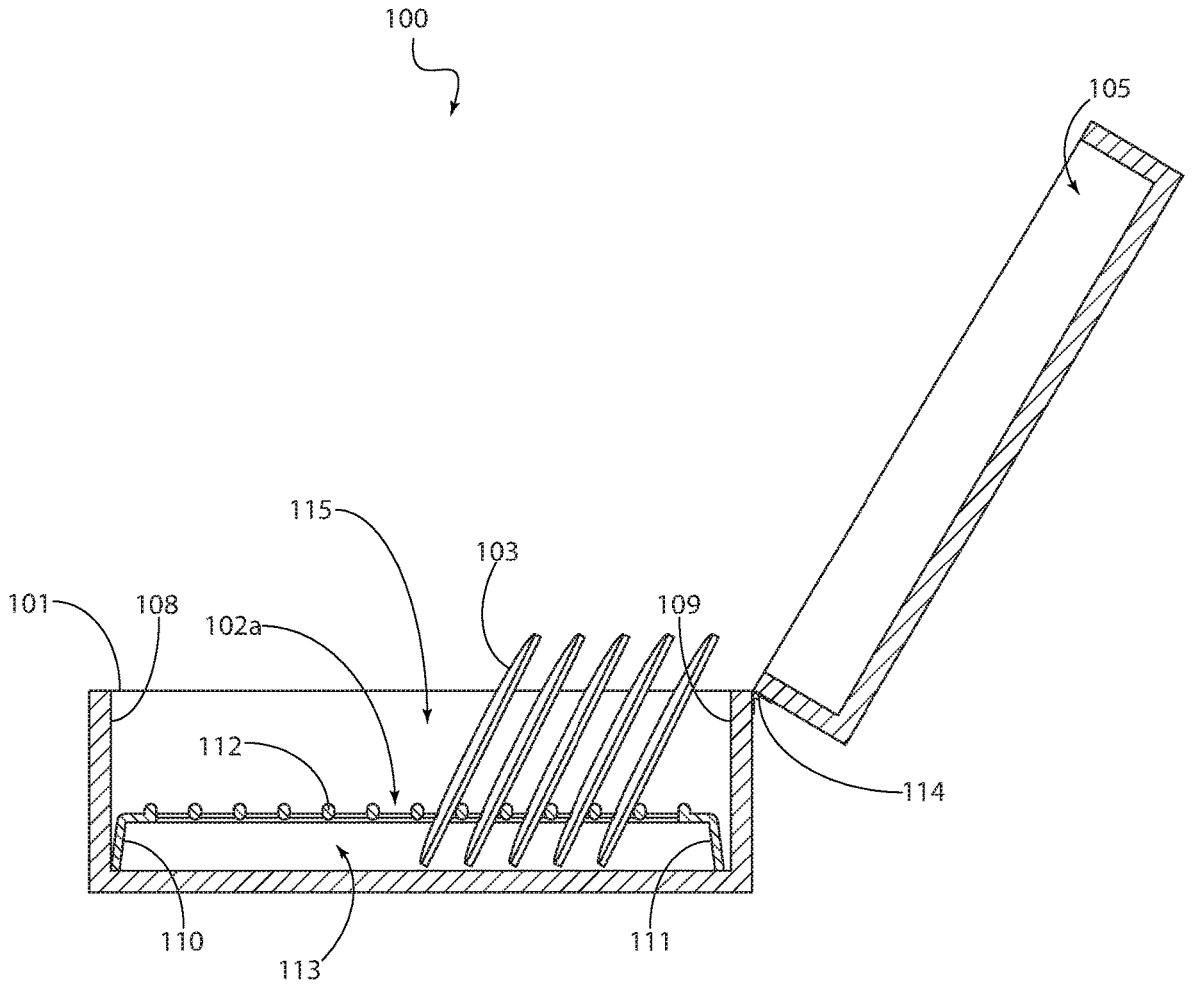
FIG. 7 illustrates a cross-sectional view of a system for displaying buttons in accordance with some exemplary embodiments of the present invention.
Figure 8:
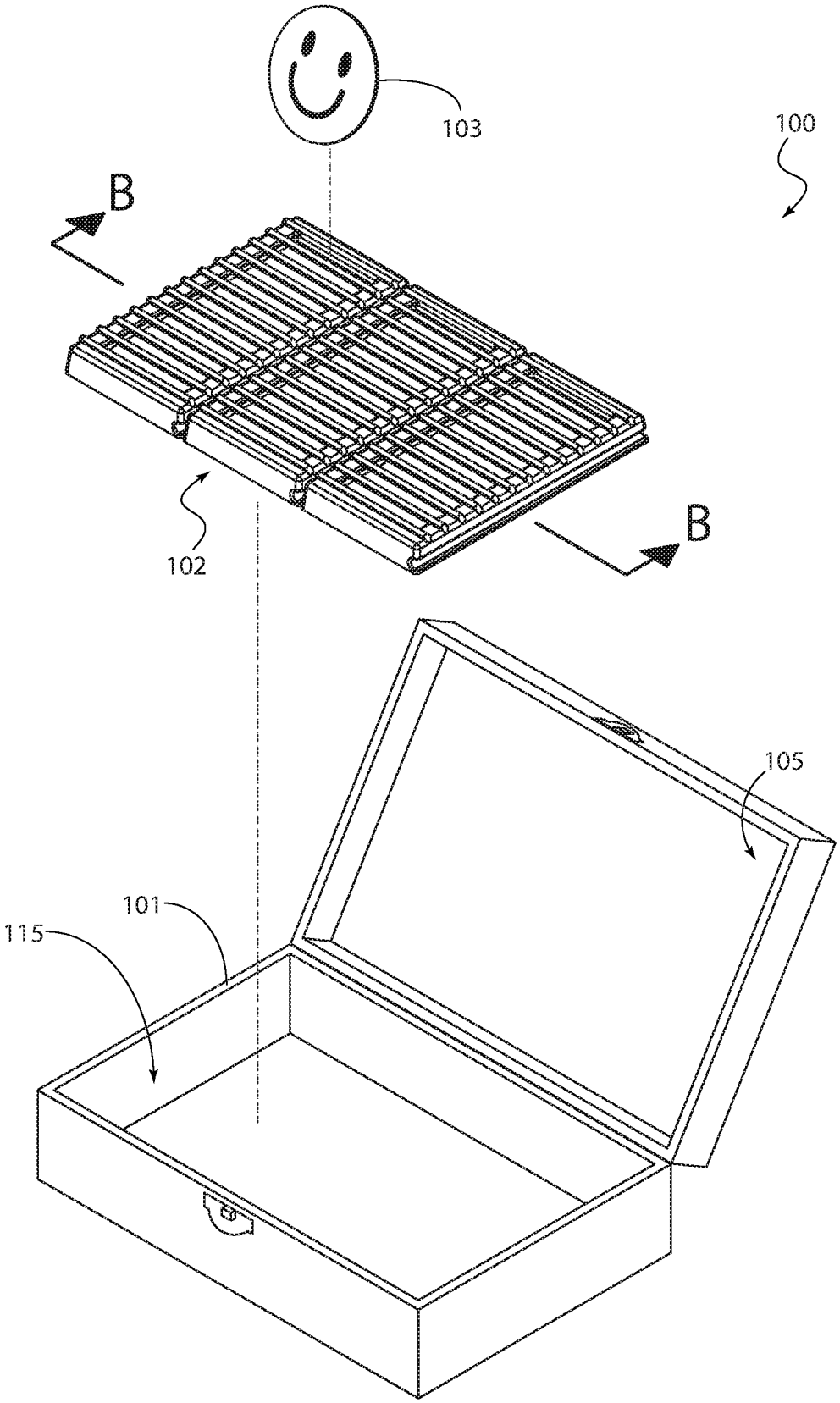
FIG. 8 illustrates an exploded view of a system for displaying buttons in accordance with some exemplary embodiments of the present invention.

Turning now to the next set of figures, FIG. 5 illustrates a perspective view of a system for displaying buttons in accordance with some exemplary embodiments of the present invention; FIG. 6 illustrates a top view thereof; FIG. 7 illustrates a cross-sectional view thereof; and FIG. 8 illustrates an exploded view of the exemplary system in these sets of figures.

More specifically, FIG. 5-FIG. 8 illustrate system 100, which includes a storage container 101, and a modular rack assembly removably 102 coupled to an interior of the storage container 101, the modular rack assembly 102 including a plurality of modular rack trays (see for example FIG. 9-FIG. 14), each of the plurality of modular rack trays including a plurality of slits 119 configured to receive a portion of a button 103 positioned in a slanted orientation. In exemplary embodiments, each modular rack tray comprises: a base 118 (having walls 110 and 111); and a rack 112 on a top surface of the base 118 forming the slits 119 configured to receive a portion of a button positioned in a slanted orientation.

In exemplary embodiments, the storage container 101 comprises a rectangular box adapted to snuggly receive the modular rack assembly 102, wherein a lid 104 of the storage container comprises a cavity 105 to receive a portion of one or more buttons 103 positioned within each of the plurality of slits 119 of the modular rack assembly 102.

Generally, in exemplary embodiments, the storage container 101 includes walls 108, 109 in between which the modular rack assembly fits snugly within a cavity 115 of the storage container 101. In exemplary embodiments, the lid 104 is attached to the storage container 104 by way of a hinge 114, although any other manner of removably coupling the lid 104 to the storage container 101 may be employed without deviating from the scope of the present invention.

In exemplary embodiments only a single rack tray may be employed. However, in some exemplary embodiments, such as the one depicted in FIG. 6, a plurality of modular rack trays 102*a*, 102*b*, and 102*c* may be coupled together to form modular rack assembly 102.

Focusing particularly on FIG. 7, a cross-sectional view of system 100 along line segment A-A as shown in FIG. 5 is depicted. From tis view, it may be appreciated that a front wall 110 and a back wall 111 of modular rack tray 102*a* (as with the other modular rack trays 102*b* and 102*c*) snuggly fits inside cavity 115 of the storage container. From tis view, as will be further discussed with reference to other figures as well, it can also be appreciated that a cavity 113 is formed beneath the rack of each tray, between a front wall and a back wall 110, 111 of each modular tray, such that there is room to fit a portion of a button 103. In this way, each button 103 may be received within the storage container and be able to be slanted so that a photo or design of the button 103 may be displayed in a manner that can be easily gleaned by users.

As shown in this figure, in exemplary embodiments, the front wall and the back wall 110, 111 may be slightly slanted. Moreover, it may be appreciated that in some exemplary embodiments as shown in FIG. 7, there may be very little room between walls 108 and 109 of the storage container 101, and the modular rack assembly 102.

FIG. 8 depicts an exploded view system 100, in accordance with some exemplary embodiments of the present invention, comprising: a storage container 101, and a modular rack assembly 102 removably coupled to an interior of the storage container 101, the modular rack assembly 102 including a plurality of modular rack trays 102*a*, 102*b*, and 102*c*, each of the plurality of modular rack trays 102*a*, 102*b*, and 102*c* including a plurality of slits 119 (see the discussion below) configured to receive a portion of a button 103 positioned in a slanted orientation.

Turning now to the next figure, FIG. 9 illustrates an exploded side view of an apparatus for displaying buttons in accordance with some exemplary embodiments of the present invention. More specifically this view depicts an exploded view of modular rack assembly 102, which includes modular rack trays 102*a*, 102*b*, and 102*c*.

In some exemplary embodiments, each of modular rack trays 102*a*, 102*b*, and 102*c* include a base 116 with a side wall 117 having a channel 117*a* along a length of the side wall 117. Typically, the channel 117*a* along the length of the side wall 117 is configured to removably couple with a complimentary protruding member 121 (see for example FIG. 11) of at least one of the plurality of modular rack trays 102*a*, 102*b*, and 102*c* of the modular rack assembly 102.

In some exemplary embodiments, each of the modular rack trays 102*a*, 102*b*, and 102*c* of the modular rack assembly 102 include a base 116, and a rack 112 on a top surface 118 of the base 116 forming the slits 119 configured to receive a portion of a button positioned in a slanted orientation. In exemplary embodiments, the plurality of slits 119 are positioned perpendicular to a length L of each modular rack tray (see FIG. 10, for example).

In some exemplary embodiments, a top surface of the first side wall and a top surface 118 of each of the side walls 117 and 121 include a plurality of grooves 126 adapted to receive the plurality of rails 119 perpendicularly secured between the side walls 117 and 121.

In some exemplary embodiments, the channel 117*a* along the length of the side wall 117 extends an entirety of the length of the side wall 117. Of course, in other exemplary embodiments, the channel 117 may extend only a portion of the length, although extending throughout an entire length may be desirable to more easily facilitate the coupling of each of the modular rack trays 102*a*, 102*b*, and 102*c* of the modular rack assembly 102.

In some exemplary embodiments, as depicted in FIG. 10 by way of example and without limiting the scope of the present invention, at least one of the plurality of modular rack trays—for example a modular rack trays 102*d*—excludes the channel 117*a* along the length of the side wall 117 and instead has a smooth solid wall 117*b*. Such modular rack tray may be used at an end portion so that the modular rack assembly 102 better and more snuggly fits inside a storage container such as storage container 101 of system 100.

Figure 11:
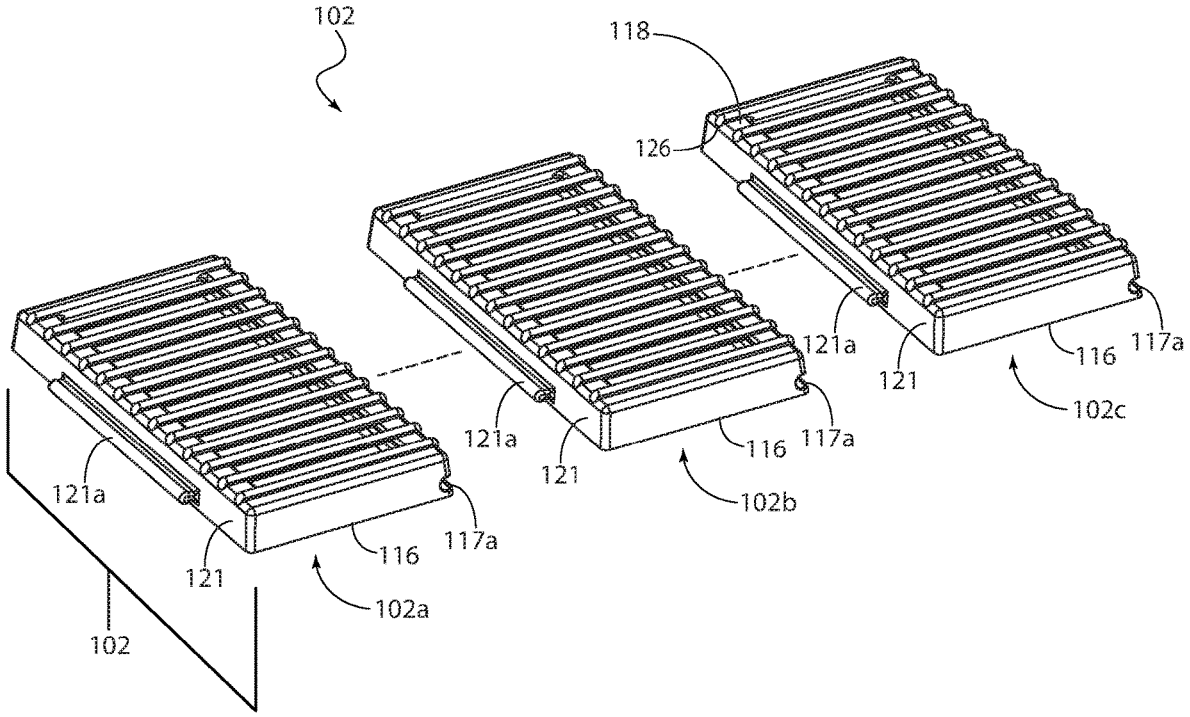
FIG. 11 illustrates an exploded view of an apparatus for displaying buttons in accordance with some exemplary embodiments of the present invention.

Turning now to the next figure, FIG. 11 illustrates an exploded side view of an apparatus for displaying buttons in accordance with some exemplary embodiments of the present invention. More specifically this view depicts an exploded view of modular rack assembly 102, which includes modular rack trays 102*a*, 102*b*, and 102*c*. From this other side view, it may be appreciated that in some exemplary embodiments, each of modular rack trays 102*a*, 102*b*, and 102*c* include a side wall 121 opposite of the side wall 117, which includes a protruding member 121*a* along a length of the side wall 121, wherein the protruding member 121*a* along the length of the side wall 121 is configured to removably couple with a complementary channel 117*a* of at least one of the plurality of modular rack trays 102*a*, 102*b*, and 102*c* of the modular rack assembly 102.

In some exemplary embodiments, the protruding member 121*a* along the length of the side wall 121 extends partially the length of the side wall 121. Of course, in other exemplary embodiments, the protruding member 121*a* may extend an entirety of the length, although extending partially the length of the side wall 121 may be desirable to more easily facilitate the coupling of each of the modular rack trays 102*a*, 102*b*, and 102*c* of the modular rack assembly 102, and to conserve materials and minimize costs of construction.

Figure 12:
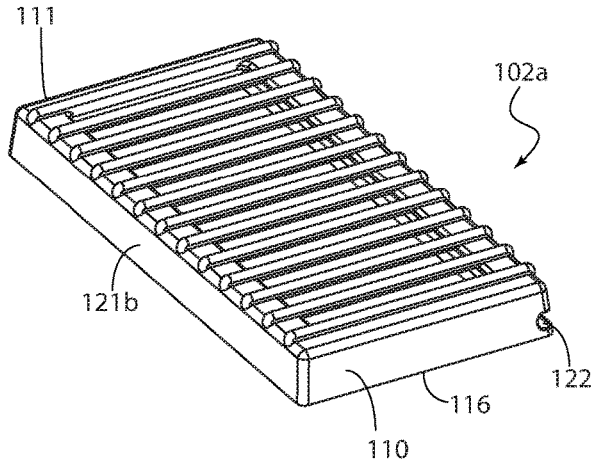
FIG. 12 illustrates a perspective view of an apparatus for displaying buttons in accordance with some exemplary embodiments of the present invention.

In some exemplary embodiments, as depicted in FIG. 12 by way of example and without limiting the scope of the present invention, at least one of the plurality of modular rack trays—for example a modular rack trays 102*e*—excludes the protruding member 121*a* along the length of the side wall 121 and instead has a smooth solid wall 121*b*. Such modular rack tray may be used at an end portion so that the modular rack assembly 102 better and more snuggly fits inside a storage container such as storage container 101 of system 100.

Figure 13:
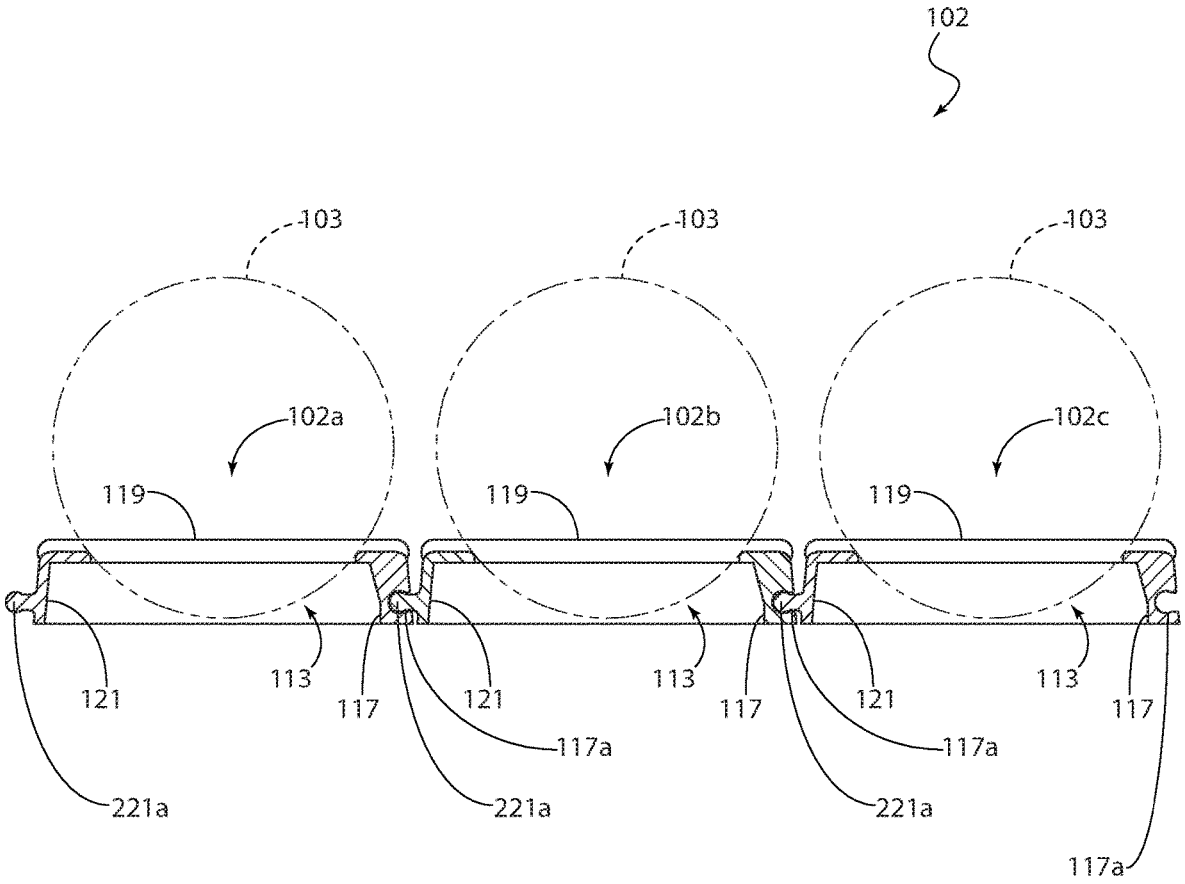
FIG. 13 illustrates a cross-sectional view of an apparatus for displaying buttons in accordance with some exemplary embodiments of the present invention.

Turning now to the next figure, FIG. 13 illustrates a cross-sectional view of an apparatus for displaying buttons in accordance with some exemplary embodiments of the present invention. More specifically, this view depicts a cross-sectional view of modular rack tray assembly 102, along line segment B-B as shown in FIG. 8. From this view, it may be appreciated that cavity 113 is formed in between front walls 110 and back walls 111 of each of each of the modular rack trays 102*a*, 102*b*, and 102*c* of the modular rack assembly 102, but also between an interior region of each of side walls 117 and 121 each of the modular rack trays 102*a*, 102*b*, and 102*c* of the modular rack assembly 102. In this cavity 113, and more specifically in between each of the plurality of rails 119 perpendicularly secured between the side walls 117 and the side walls 121 forming the slits 118, a portion of a button may be received.

Accordingly, a system for displaying buttons 100 may comprise: a storage container 101; and a modular rack assembly 102 removably coupled to an interior of the storage container 101, the modular rack assembly 102 including a plurality of modular rack trays 102*a*, 102*b*, and 102*c*, each of the plurality of modular rack trays 102*a*, 102*b*, and 102*c* including: a base 116; a first side wall 121 having a protruding member 121*a* along a length of the first side wall 121; a second side wall 117 having a channel 117*a* along a length of the second side wall 117; and a plurality of rails 119 perpendicularly secured between the first side wall 121 and the second side wall 117 forming the slits 120 configured to receive a portion of a button, wherein: the protruding member 121*a* along the length of the first side wall 121 is configured to removably couple with a complementary channel 117*a* of at least one of the plurality of modular rack trays 102*a*, 102*b*, and 102*c* of the modular rack assembly 102, and the channel 117*a* along the length of the second side wall 117 is configured to removably couple with a complimentary protruding member 121*a* of at least one of the plurality of modular rack trays 102*a*, 102*b*, and 102*c* of the modular rack assembly 102.

Figure 14:
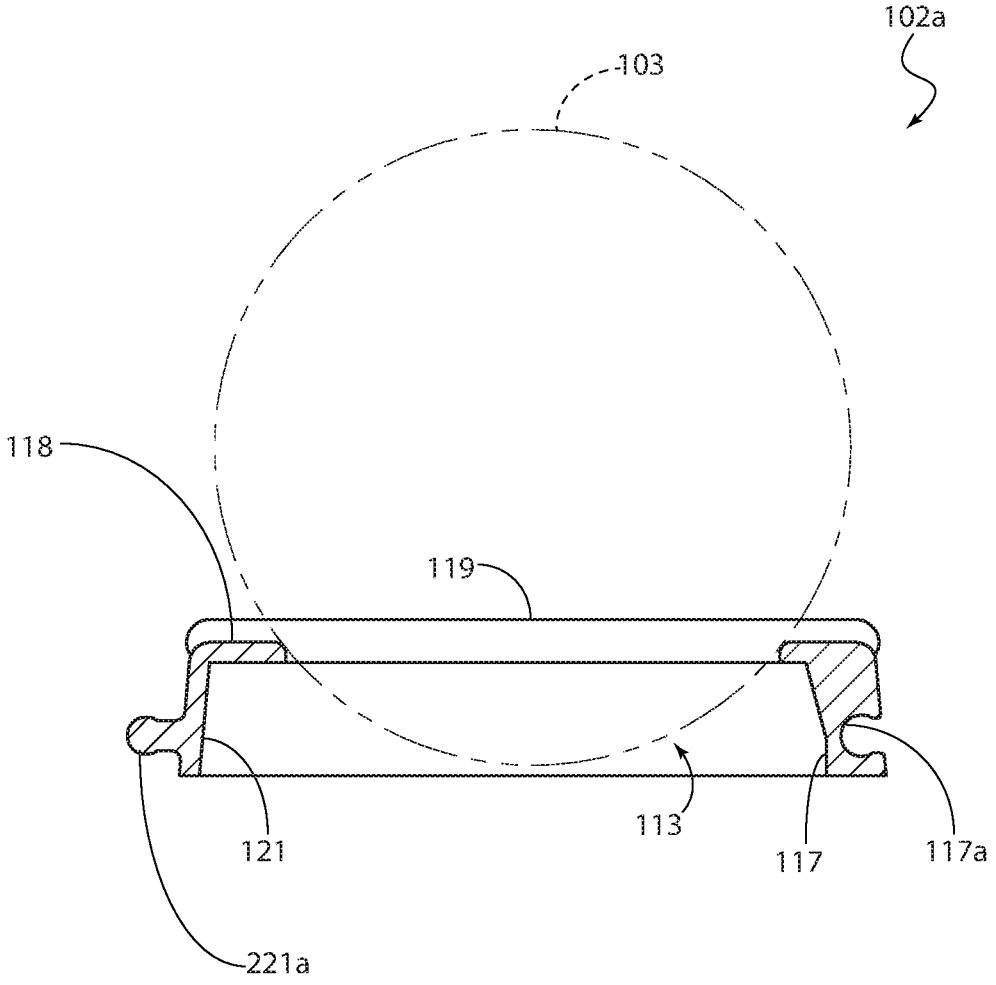
FIG. 14 illustrates a cross-sectional view of an apparatus for displaying buttons in accordance with some exemplary embodiments of the present invention.

Now turning to the last of the figures, FIG. 14 illustrates a cross-sectional view of an apparatus for displaying buttons in accordance with some exemplary embodiments of the present invention. More specifically, this view shows a single modular rack tray 102*a*. From this view, it may be appreciated that at least one of the plurality of modular rack trays may comprise: a first side wall 117 having a protruding member 117*a* along a length of the first side wall 117; and a second side wall 121 having a channel 121*a* along a length of the second side wall 121, wherein: the protruding member 121*a* along the length of the first side wall 121 is configured to removably couple with a complementary channel 117*a* of at least one of the plurality of modular rack trays 102*b* and or 102*c* of the modular rack assembly 102, and the channel 117*a* along the length of the second side wall 117 is configured to removably couple with a complimentary protruding member 121*a* of at least one of the plurality of modular rack trays 102*b* and or 102*c* of the modular rack assembly 102.

Accordingly, an apparatus such modular rack assembly 102 for displaying buttons, may comprise: a plurality of rack trays 102*a*, 102*b*, 102*c*, 102*d*, and or 102*e*, removably coupled to an interior of a storage container 101, at least one of the plurality of rack trays 102*a*, 102*b*, 102*c* including: a base 116; a first side wall 121 having a protruding member 121*a* along a length of the first side wall 121; a second side wall 117 having a channel 117*a* along a length of the second side wall 117*a*; and a plurality of rails 119 perpendicularly secured between the first side wall 121 and the second side wall 117 forming the slits 120 configured to receive a portion of a button 103 positioned in a slanted orientation, wherein: the protruding member 121*a* along the length of the first side wall 121 is configured to removably couple with a complementary channel 117*a* of at least one of the plurality of modular rack trays 102*a*, 102*b*, 102*c*, and or 102*e*, of the modular rack assembly 102, and the channel 117*a* along the length of the second side wall 117 is configured to removably couple with a complimentary protruding member 121*a* of at least one of the plurality of modular rack trays 102*a*, 102*b*, 102*c*, and or 102*d*, of the modular rack assembly.

It is to be understood that the present invention is not limited to the sole embodiment described above but encompasses any and all embodiments within the scope of the following claims.

A system and apparatus for displaying buttons has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A system for displaying buttons, comprising:

a storage container; and a modular rack assembly removably coupled to an interior of the storage container, the modular rack assembly including a plurality of modular rack trays, each of the plurality of modular rack trays including:

a base;

a first side wall having a protruding member along a length of the first side wall;

a second side wall having a channel along a length of the second side wall;

a plurality of rails perpendicularly secured between the first side wall and the second side wall forming the slits configured to receive a portion of a button; and a top surface of the first side wall and a top surface of the second side wall include a plurality of grooves adapted to receive the plurality of rails perpendicularly secured between the first side wall and the second side wall, wherein:

the protruding member along the length of the first side wall is configured to removably couple with a complementary channel of at least one of the plurality of modular rack trays of the modular rack assembly, and the channel along the length of the second side wall is configured to removably couple with a complimentary protruding member of at least one of the plurality of modular rack trays of the modular rack assembly.

2. The system of claim 1, wherein at least one of the plurality of modular rack trays excludes the protruding member along the length of the first side wall or excludes the channel along the length of the second side wall.

3. The system of claim 1, wherein the protruding member extends partially the length of the first side wall.

4. The system of claim 1, wherein the channel extends an entirety of the length of the first side wall.

5. The system of claim 1, wherein the storage container comprises a hinged lid.

6. The system of claim 1, wherein the storage container comprises a rectangular box adapted to snuggly receive the modular rack assembly.

7. The system of claim 1, wherein a lid of the storage container comprises a cavity to receive a portion of one or more buttons positioned within each of the plurality of slits of the modular rack assembly.

8. An apparatus for displaying buttons, comprising:

a plurality of rack trays removably coupled to an interior of a storage container, at least one of the plurality of rack trays including:

a base;

a first side wall having a protruding member along a length of the first side wall;

a second side wall having a channel along a length of the second side wall;

a plurality of rails perpendicularly secured between the first side wall and the second side wall forming the slits configured to receive a portion of a button positioned in a slanted orientation; and a top surface of the first side wall and a top surface of the second side wall include a plurality of grooves adapted to receive the plurality of rails perpendicularly secured between the first side wall and the second side wall, wherein:

the protruding member along the length of the first side wall is configured to removably couple with a complementary channel of at least one of the plurality of modular rack trays of the modular rack assembly, and the channel along the length of the second side wall is configured to removably couple with a complimentary protruding member of at least one of the plurality of modular rack trays of the modular rack assembly.

* * * * *